US005490355A

United States Patent [19]

Galeazzi et al.

[11] Patent Number: 5,490,355

[45] **Date of Patent: *Feb. 13, 1996**

[54] WASTE COLLECTION DEVICE

[76] Inventors: Giancarlo Galeazzi; Angelo Fusaro, both of Via Roma, 78, 46049 Volta Mantovana (Prov. of Mantova), Italy

[ * ] Notice: The term of this patent shall not extend beyond the expiration date of Pat. No. 5,140,786.

[21] Appl. No.: 236,806

[22] Filed: May 2, 1994

[30] Foreign Application Priority Data

May 7, 1993 [IT] Italy ..... MN93A0009

[51] Int. Cl.[6] ..... E02D 27/00

[52] U.S. Cl. ..... 52/29; 52/169.6

[58] Field of Search ..... 52/169.6, 29; 220/484

[56] References Cited

U.S. PATENT DOCUMENTS

| | | | |
|---|---|---|---|
| 323,224 | 7/1885 | Smith | 406/196 |
| 592,190 | 10/1897 | Bond | 52/169.6 |
| 2,064,538 | 12/1936 | Hagan | 220/484 |
| 5,022,202 | 6/1991 | Johnson | 52/169.6 |
| 5,140,786 | 8/1992 | Galeazzi | 52/169.6 X |

FOREIGN PATENT DOCUMENTS

| | | | |
|---|---|---|---|
| 454428 | 6/1968 | Switzerland | 52/169.6 |

*Primary Examiner*—Carl D. Friedman
*Assistant Examiner*—Beth C. Aubrey
*Attorney, Agent, or Firm*—Guido Modiano; Albert Joshif

[57] ABSTRACT

The improved waste collection device has a container housed in a pit, closed by a lid and supported on a base. The base is mounted on a telescopic lifting mechanism for moving the container between a lowered position, whereat the base is located proximate to the bottom of the pit and a raised position, whereat the base is located flush with the pavement surrounding the pit. A hollow column is provided in the lid for introducing waste material into the container. Upon filling the container and hollow column with waste, spaces remain empty at the upper part of the container. The hollow column defines a volume which is, at most, equal to the spaces which remain empty in the container. Waste accumulated within the column is displaced into the empty spaces in the container upon removing the container from the base for emptying.

10 Claims, 2 Drawing Sheets

21
18
15
24
22
23
17
16
14
19
20

40

32
39
35
28
27
25
29
39
33a
34
33b
38
37
35a
35c
30
26
35b
36
31

WASTE COLLECTION DEVICE

BACKGROUND OF THE INVENTION

The present invention relates to an improved waste collection device.

It is known that many aesthetically, functionally and hygienically disadvantageous characteristics are linked to the municipal solid waste collection methods currently most commonly practiced, which consist in the use of large bins placed at the curbside and in which users place the waste contained in bags and other containers.

In order to obviate these disadvantages, the same Applicants have described, in U.S. patent application Ser. No. 07/670,853 of Mar. 18, 1991, now U.S. Pat. No. 5,140,786, a device comprising a structure provided with a base and a lid that are mutually connected so as to delimit a portion of space for accommodating a container that receives the waste. Waste is introduced into the container through a hollow column or chute connected to the lid of the container. The structure is connected to lifting means that move it between a first lowered position, in which the container is concealed inside a pit and the lid is flush with the surrounding paving, and a second raised position in which the structure protrudes from the pit and the base is flush with the pavement surface surrounding the pit.

The same Applicants subsequently described, in U.S. patent application Ser. No. 08/184,337 of Jan. 21, 1994, a device comprising a pit internally provided with a lifting unit that moves at least one waste container from a lowered position in which it is completely inserted in the pit, to a raised position in which the container protrudes completely therefrom; the pit is furthermore provided, at its upper rim, with an openable lid located at the level of the surrounding paving when it is in a closed or lowered position and comprising at least one hollow column associated therewith for inserting waste into the at least one container.

SUMMARY OF THE INVENTION

Both of these solutions are highly effective, but experience so far gained has allowed to provide a new improved device aimed at optimizing the operation of the above mentioned solutions.

A first of the problems to be solved is envisaged in obtaining full replenishment of the waste container. However, in providing the solution of this first problem, a second problem arises when the waste container or bin is fully replenished with waste material, users continue to introduce waste into the hollow column or hopper through which the waste material is discharged into the waste container or bin, and therefore the hopper also becomes packed full of waste material. This situation is shown in FIGS. 2, 3 and 4, which will be described hereinafter. When the waste container or bin is subsequently removed or discharged, the waste material contained in the hopper either falls by gravity outside the bin or remains packed in the hopper, depending on the nature of the waste material. As a consequence thereof, when the discharged bin is returned in its initial position, remains of previous waste material are present either in the pit where the bin is arranged or in the hopper with consequent putrefaction problems.

With this aim in view, there is provided, according to the invention, an improved waste collection device, comprising at least one waste insertion column connected to a lid, said lid closing a pit and being connected to at least one waste container resting on a base, said base being connected to lifting means for moving said container between a lowered position, whereat said base lies proximate to the bottom of the pit, and a raised position, whereat said base is flush with a pavement surface surrounding said pit, characterized in that said at least one column defines a volume which is equal, at the most, to a volume of the empty spaces that form inside a container above a pile of waste accumulated below said column when said container is full.

BRIEF DESCRIPTION OF THE DRAWINGS

Further characteristics and advantages will become apparent from the description of some preferred but not exclusive embodiments of the invention, illustrated only by way of non-limitative example in the accompanying drawings, wherein.

DESCRIPTION OF THE PREFERRED EMBODIMENTS

Figure 2:
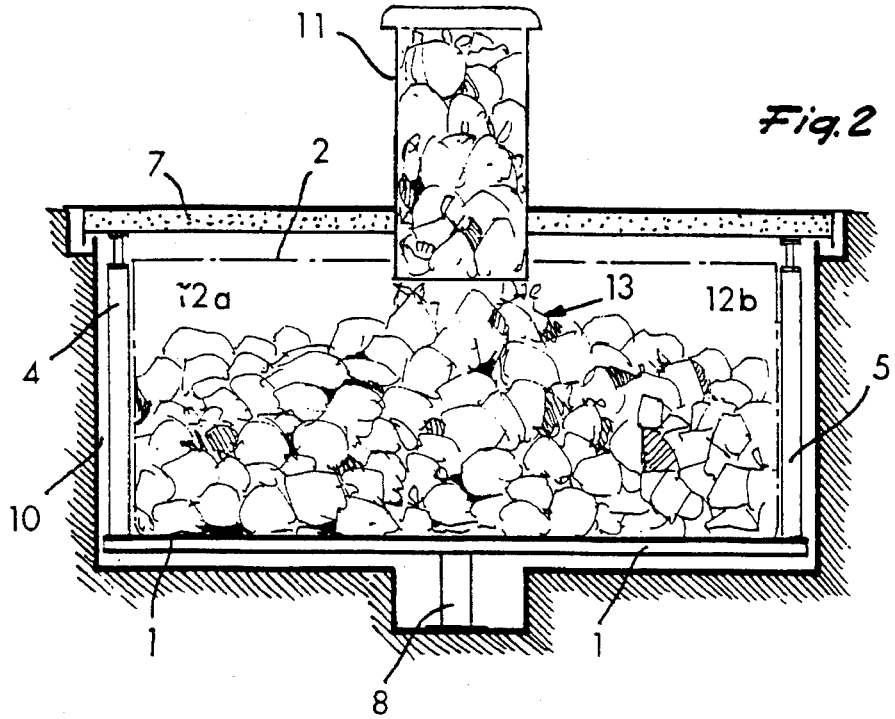
FIG. 2 is a sectional view of a first embodiment of the invention with the container in a lowered position in which it is inserted in the pit and completely filled.
Figure 1:
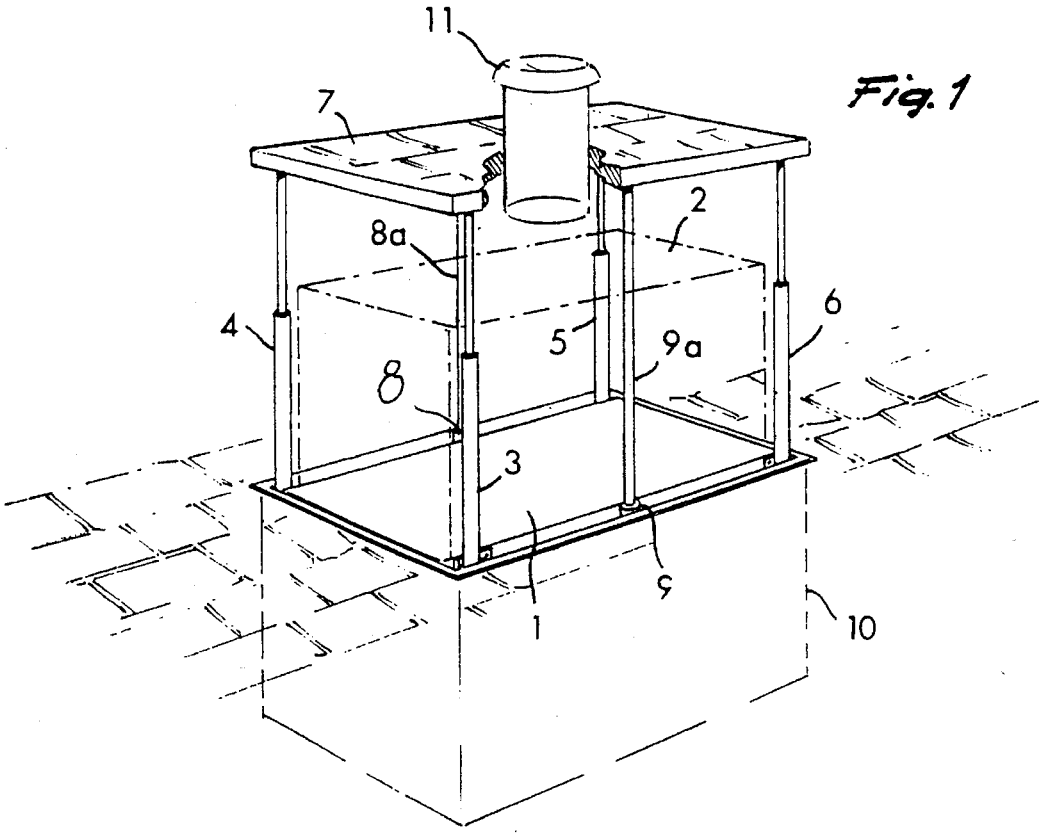
FIG. 1 is a perspective view of a first embodiment of the invention with a waste container in a raised position in which it protrudes completely from the pit.

With reference to the above FIGS. 1 and 2, the device according to a first embodiment comprises a structure formed by a base 1, and a waste container 2 which rests on the base 1. The base is connected, by means of telescopic columns 3, 4, 5 and 6, to the lid 7 on which the stems 8*a*, 9*a* of the actuation cylinders 8 and 9 act; said cylinders move the structure between the lowered position shown in FIG. 2, in which it is concealed within the pit 10 so that the lid 7 is flush with the surrounding paving and the telescopic columns 4 and 5 are all fully retracted, and the raised position of FIG. 1, in which the structure protrudes completely from the pit 10, so that the base 1 is flush with the surrounding paving and the telescopic columns 4 and 5 are fully extended.

The lid 7 is provided with a monolithically associated chute or hollow column 11, for the insertion of waste contained in bags or the like inside the container 2. The column 11 has, according to an important characteristic of the invention, a volume that is substantially equal to the sum of the volumes of the empty spaces 12*a*, 12*b* that form inside the container 2 above the pile of waste 13 accumulated at the column 11 when it is full. As will be apparent to one skilled in the art of waste disposal, the volume of the empty spaces in the container can be calculated or measured in any conventional manner. For example, the volume of the empty spaces in an open container may be easily and directly deduced by measurement in order to determine the size of the column.

When the condition shown in FIG. 2 is reached as users continue to insert waste bags, naturally it is necessary to empty the container 2; the actuation cylinders 8 and 9 are then actuated, and the first effect that is obtained is the lifting of the lid 7 with respect to the base 1 until the telescopic columns 3, 4, 5 and 6 are fully elongated.

In this step, the direction of the relative motion of the column 11 with respect to the container 2 is at right angles to the base 1 and therefore spaces said column from the container 2, consequently emptying all the bags contained in the column so that they fill the spaces 12*a*, 12*b* until then left empty.

In this manner the operation of the container 2 is optimized; when it is moved for emptying, it is always completely full.

The described step is followed by the complete protrusion of the stems 8*a*, 9*a* of the actuation cylinders 8 and 9 so as to achieve the situation shown in FIG. 1, which allows to extract the container 2 so that it can be emptied into an appropriate removal vehicle and then be returned to its original position and placed back into the pit 10.

Figure 3:
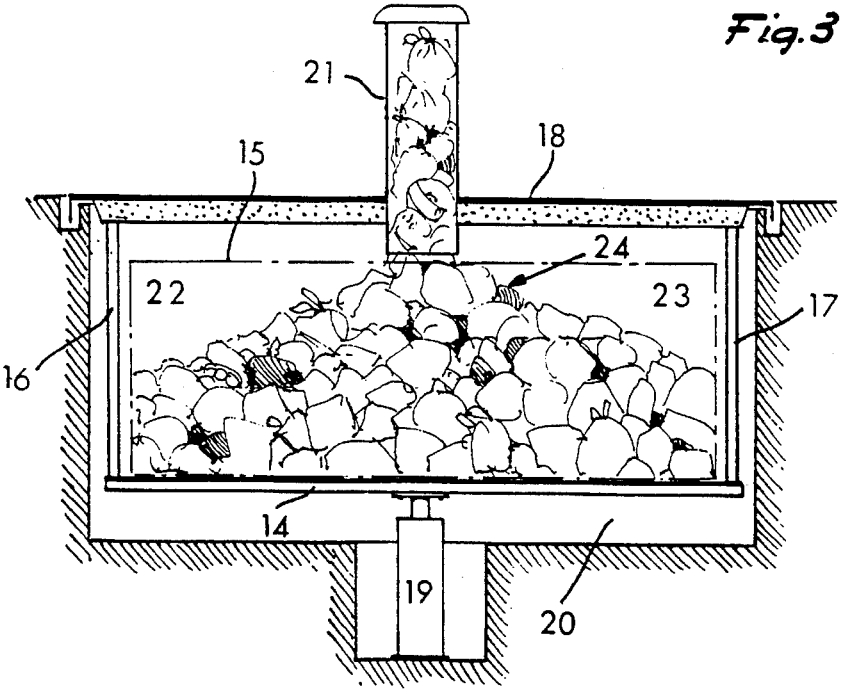
FIG. 3 is a sectional view of a second embodiment of the invention in the same conditions provided for the first embodiment in FIG. 2.

FIG. 3 illustrates a first variation of the invention which comprises the base 14, supporting the waste container 15 and connected to the lid 18 by means of monolithic columns 16 and 17; the actuation cylinder 19 moves the structure between the position in which it is concealed within the pit 20, as shown in the figure, so that the lid 18 is flush with the surrounding paving, and a position in which the structure fully protrudes from said pit so that the base 14 is flush with said paving.

The lid 18 is provided with the column 21 monolithically associated therewith, for inserting the waste inside the container 15; the volume of said column is substantially equal to the volume of the empty space 22 or to the volume of the empty space 23. In the embodiment of FIG. 3, wherein the column 21 is at the center of the lid 18, the volumes of empty spaces 22, 23 are identical and are formed inside the container 15 above the pile of waste 24 accumulated at the column 21 when it is full.

When it is necessary to empty the container 15, the structure is moved so that the base 14 is flush with the surrounding paving, and the container 15 is extracted from said structure by moving it with respect to the column 21 parallel to the base 14.

Assuming that the container 15 moves to the right, the bags of waste contained in the column 21 empty into the empty space 22 located downstream of the column with respect to the direction of movement of the container, filling said space; clearly, if the container 15 moves to the left the empty space that fills with the bags contained in the column is the one designated by the reference numeral 23, which in this case is located downstream of the column with respect to the direction of the movement.

Figure 4:
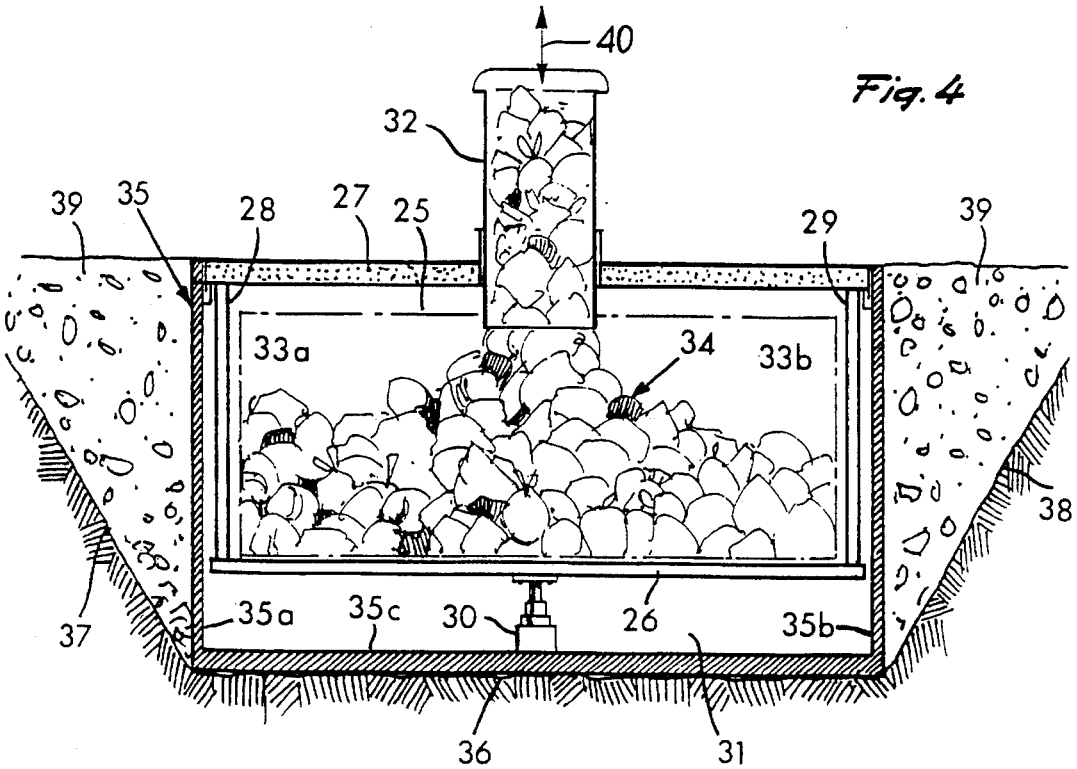
FIG. 4 is a sectional view of a third embodiment of the invention in the same conditions provided for the first and second embodiments in FIGS. 2 and 3 respectively.

FIG. 4 illustrates a second variation of the invention, wherein the structure suitable to accommodate the waste container 25 comprises the base 26, connected to the lid 27 by means of monolithic columns 28 and 29. The actuation cylinder 30 moves the container 25 between the lowered position shown in the figure, in which it is concealed inside the pit 31, and a raised position in which the container 25 fully protrudes from said pit, so that its base 26 is flush with the surrounding paving.

The hollow column or chute 32 for inserting the waste in the container 25 is telescopically connected to the lid 27 so that it can move with respect to the lid in the two directions indicated by the arrow 40 shown in FIG. 4; the volume of said column is substantially equal to the sum of the volumes of the empty spaces 33*a*, 33*b* that form above the pile of waste 34 accumulated at the column 32 when it is full.

When it is necessary to empty the container 25, the first maneuver that is performed is the lifting of the column 32 with respect to the lid 27 with a motion that is at right angles to the base 26: this empties the bags of waste contained in said column so as to fill the empty spaces 33*a* and 33*b*, thus completely filling the container 25.

The structure is then extracted from the pit 31 by using the actuation cylinder 30, so as to extract the container 25 from said structure in order to empty it into a removal vehicle.

The dimensioning of the waste insertion column such as those shown in FIGS. 2 and 4 is even possible whenever the relative motion of said column and of the waste container has at least one component at right angles to the supporting base of the container during the first maneuvers for emptying said container; this is the case, for example, of the device according to U.S. patent application Ser. No. 08/184,337 mentioned earlier, in which the lid of the pit is hinged to the rim of said pit and, when opened to allow the exit of the waste container from the pit, performs a rotation that indeed causes a movement of the hollow column that has a gradually decreasing component at right angles to the supporting base of the container.

The embodiment shown in FIG. 4 includes a further characteristic that might be applied indifferently to the other embodiments described.

This characteristic is the fact that the device is contained, with all its elements, inside the monolithic shell 35, which comprises walls 35*a*, 35*b* and a bottom 35*c*, and which, during the installation of the device, is inserted in the excavated pit that has a base 36 for supporting the bottom 35*c* and the walls 37, 38.

This allows very rapid installation of the device, since the pit is excavated shortly before said installation; then the shell 35 is put in place with the fully assembled device contained therein; and then the spaces adjacent to the shell are filled with filler material 39 in order to quickly restore the paving at the edges of said shell.

The described invention is susceptible to numerous modifications and variations, all of which are within the scope of the inventive concept; accordingly, for example, the number of columns installed on the lid may be any, and the number of containers resting on the base of the structure may equally be any.

In the practical embodiment of the invention, all the details may be replaced with other technically equivalent elements; furthermore, the materials employed, as well as the shapes and dimensions, may be any.

In two of the above described embodiments the hollow column or hopper 11, 32 extends downwardly beyond the respective lid 7, 18, 27 over a selected length and selectively penetrates with its lower end portion into the space of the waste container or bin. The length of penetration of the lower end portion of the hopper 11, 32 into the bin determines the degree of replenishment of the bin with waste material, taking into account that normally the discharged waste material has the tendency to assume the disposition of a friction cone, like in the case of granular material, depending on the friction coefficient and cohesion between the particles, which in this case are normally bags of plastic material full of waste.

The dimensioning of the hopper, i.e. the dimension of the diameter thereof and the axial extent and the length of penetration of the lower end of the hopper into the bin are preferably selected so that the volume of the hopper should preferably not exceed from about 10% to about 25% of the volume of the waste container or bin, i.e. the length of penetration of the lower end of the hopper into the bin is selected so that the volume of the space left free within the bin, when no more waste material can be discharged through the hopper into the bin, is from about 10% to about 25% of the volume of the waste container or bin.

Usually but not exclusively the waste container or bin 2, 15, 25 is in the form of an upwardly open box of parallelepiped shape of metallic or plastics material with a standard length of 1220 mm, a width of 850 mm and a height of 1050 so that the standard volume thereof is about 1,1 $m^3$.

As mentioned said waste container or bin is upwardly open and has an upper peripheral edge thereof defining an upward opening of said container, wherein in closed position of said lid, said waste insertion column connected to said lid and located above said upward opening of said container has a lower end portion thereof extending into said waste container beyond said upper peripheral edge thereof over a pre-selected length to determine the degree of replenishment of said waste container with waste material discharged therein through said waste insertion column.

The hopper 11, 21, 32 has preferably but not exclusively an inverted cone frustum shape with an elliptical cross section, which at the upper end has a major axis of 585 mm and a minor axis of 280 mm and at the lower end a lower end cross section with a major axis of 680 mm and minor axis of 320 mm and a height of 1020 mm, so that the volume of the hopper is 0,2 $m^3$. Preferably the lower end of the hopper 11, 32 penetrates into the bin over a length of about 20 cm.

It should be noted that those not fully illustrated structural details of the component parts shown and illustrated above are the same as the corresponding structural details shown in the above mentioned U.S. Pat. No. 5,140,786 and U.S. patent application Ser. No. 08/184,337, which are hereby incorporated by reference.

What is claimed is:

1. In combination:

a pit;

paving surrounding said pit;

lifting means located in said pit;

a base connected to said lifting means;

a container resting on said base, said lifting means being operable for moving said base and said container between a lowered position, whereat said base lies proximate to the bottom of the pit, and a raised position whereat said base is flush with said paving surrounding said pit;

a lid overlying said container;

a hollow column connected to said lid for introducing waste into said container to form a pile of waste within said container, and;

empty spaces defined upwardly within said container between said pile of waste and said lid;

wherein said hollow column defines a volume, and wherein said volume of said hollow column is equal to a volume of at least one of said empty spaces.

2. The combination of claim 1, wherein said column is movable in direction having a component at right angles to said base, and wherein said column defines a volume substantially equal to a volume defined by said empty spaces.

3. The combination of claim 1, said container is movable in a direction parallel to said base, in said raised position thereof, said column having a volume substantially equal to a volume defined by at least one of said empty spaces located between said pile of waste and said lid and downstream of said column with respect to said direction parallel to said base.

4. The combination of claim 1, further comprising telescopic columns connecting said base to said lid, and wherein said column is connected monolithically to said lid.

5. The combination of claim 1, further comprising monolithic columns connecting said base to said lid, and wherein said column is connected monolithically to said lid.

6. The combination of claim 1, further comprising monolithic columns connecting said base to said lid, and wherein said column is connected telescopically to said lid.

7. The combination of claim 1, further comprising a shell, said shell lining said pit and containing said lifting means, said base and said container.

8. The combination of claim 1, wherein said hollow column has a lower end portion, said hollow column passing through said lid, said lower end portion protruding into said container.

9. The combination of claim 1, wherein said column has a frusto-conical shape.

10. The combination of claim 1, wherein said container defines a container volume, and wherein said empty spaces define a volume in the order of from 10% to 25% of said container volume.

* * * * *